US009085141B2

(12) United States Patent
Oya et al.

(10) Patent No.: US 9,085,141 B2
(45) Date of Patent: Jul. 21, 2015

(54) LIQUID EJECTION HEAD AND PRINTING APPARATUS

(71) Applicant: CANON KABUSHIKI KAISHA, Tokyo (JP)

(72) Inventors: Shuhei Oya, Kawasaki (JP); Satoshi Ibe, Yokohama (JP); Jun Yamamuro, Yokohama (JP); Kouji Hasegawa, Kawasaki (JP); Shiro Sujaku, Kawasaki (JP); Junya Hayasaka, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/465,231

(22) Filed: Aug. 21, 2014

(65) Prior Publication Data

US 2015/0062260 A1 Mar. 5, 2015

(30) Foreign Application Priority Data

Aug. 28, 2013 (JP) ..... 2013-176856

(51) Int. Cl.
*B41J 2/14* (2006.01)

(52) U.S. Cl.
CPC ..... *B41J 2/14* (2013.01); *B41J 2002/14411* (2013.01)

(58) Field of Classification Search
CPC ..... B41J 2/14; B41J 2/175; B41J 2/17513; B41J 2002/14411
See application file for complete search history.

(56) References Cited

U.S. PATENT DOCUMENTS

| | | | | |
|---|---|---|---|---|
| 6,517,198 | B2 * | 2/2003 | Yoshihira et al. | 347/87 |
| 8,205,967 | B2 * | 6/2012 | Uyama et al. | 347/64 |
| 8,388,106 | B2 | 3/2013 | Kurosu et al. | |
| 2009/0065472 | A1 * | 3/2009 | Asai et al. | 216/27 |
| 2009/0122125 | A1 * | 5/2009 | Owaki et al. | 347/93 |

FOREIGN PATENT DOCUMENTS

JP 2007-331245 A 12/2007

* cited by examiner

*Primary Examiner* — Manish S Shah
*Assistant Examiner* — Jeremy Delozier
(74) *Attorney, Agent, or Firm* — Fitzpatrick, Cella, Harper & Scinto

(57) ABSTRACT

A liquid ejection head and a printing apparatus can perform high-quality printing by suppressing the shrinkage stress of an adhesive joining a substrate and a flow path forming member and the deformation and peeling of the flow path forming member. A stress dispersing section is formed on the side surface of the substrate.

6 Claims, 6 Drawing Sheets

LIQUID EJECTION HEAD AND PRINTING APPARATUS

BACKGROUND OF THE INVENTION

1. Field of the Invention

The present invention relates to a liquid ejection head for ejecting liquid from an ejection opening and a printing apparatus.

2. Description of the Related Art

The printing speed and image quality of an inkjet printer become higher, and accordingly, the density of a liquid ejection head becomes higher. Accordingly, members included in the liquid ejection head become smaller and thinner. Therefore, a substrate and a flow path forming member which are major members included in the liquid ejection head tend to deform because of stress caused by adhesion or the like.

In a case where a flow path forming member deforms, an ejection opening deforms which is formed in the flow path forming member to eject liquid, and it becomes difficult to accurately land liquid at a targeted position on a printing medium. Further, there may occur a problem that the substrate and the flow path forming member peel off.

As a means for suppressing such deformation of the substrate and the flow path forming member, there is a method disclosed in Japanese Patent Laid-open No. 2007-331245. In the method disclosed in Japanese Patent Laid-open No. 2007-331245, at least one slit, groove, or dent is provided on an upper surface of the flow path forming member to relieve stress caused by the volume shrinkage of the flow path forming member, thus suppressing peeling at an interface with the substrate.

As an adhesive for joining the substrate and the flow path forming member, a thermosetting adhesive is used from the viewpoint of ink resistance. The adhesive is heated and cured and the shrinkage stress of the substrate which is generated in a case where the temperature of the substrate is returned to a normal temperature is applied in a direction to pull the flow path forming member. In the method disclosed in Japanese Patent Laid-open No. 2007-331245, grooves are provided on the upper surface of the flow path forming member to prevent deformation and peeling from being caused by stress generated by the volume shrinkage of the flow path forming member.

SUMMARY OF THE INVENTION

According to the present invention, there is provided a liquid ejection head comprising: a flow path forming member comprising an ejection opening for ejecting liquid; a substrate comprising the flow path forming member; and a support member for supporting the substrate, the support member being bonded to a surface of the substrate which is opposite to a surface of the substrate on which the flow path forming member is provided, wherein the substrate has, on a side surface thereof, a groove extending along the surface of the substrate which is opposite to the surface of the substrate on which the flow path forming member is provided.

Further features of the present invention will become apparent from the following description of exemplary embodiments (with reference to the attached drawings).

BRIEF DESCRIPTION OF THE DRAWINGS

FIG. 5E1 is a diagram illustrating the process for producing the liquid ejection head;

FIG. 5E2 is a diagram illustrating the process for producing the liquid ejection head;

DESCRIPTION OF THE EMBODIMENTS

According to a study by the inventors, although the grooves are provided on the upper surface of the flow path forming member disclosed in Japanese Patent Laid-open No. 2007-331245, the flow path forming member disclosed in Japanese Patent Laid-open No. 2007-331245 can deform, and accordingly, the ejection openings can deform and it is difficult to accurately land liquid at a targeted position on a printing medium.

Accordingly, the present invention is directed to providing a liquid ejection head and a printing apparatus capable of performing high-quality printing by suppressing the shrinkage stress of an adhesive joining a substrate and a flow path forming member and the deformation and peeling of the flow path forming member.

A first embodiment of the present invention will be described below with reference to the drawings.

Figure 1:
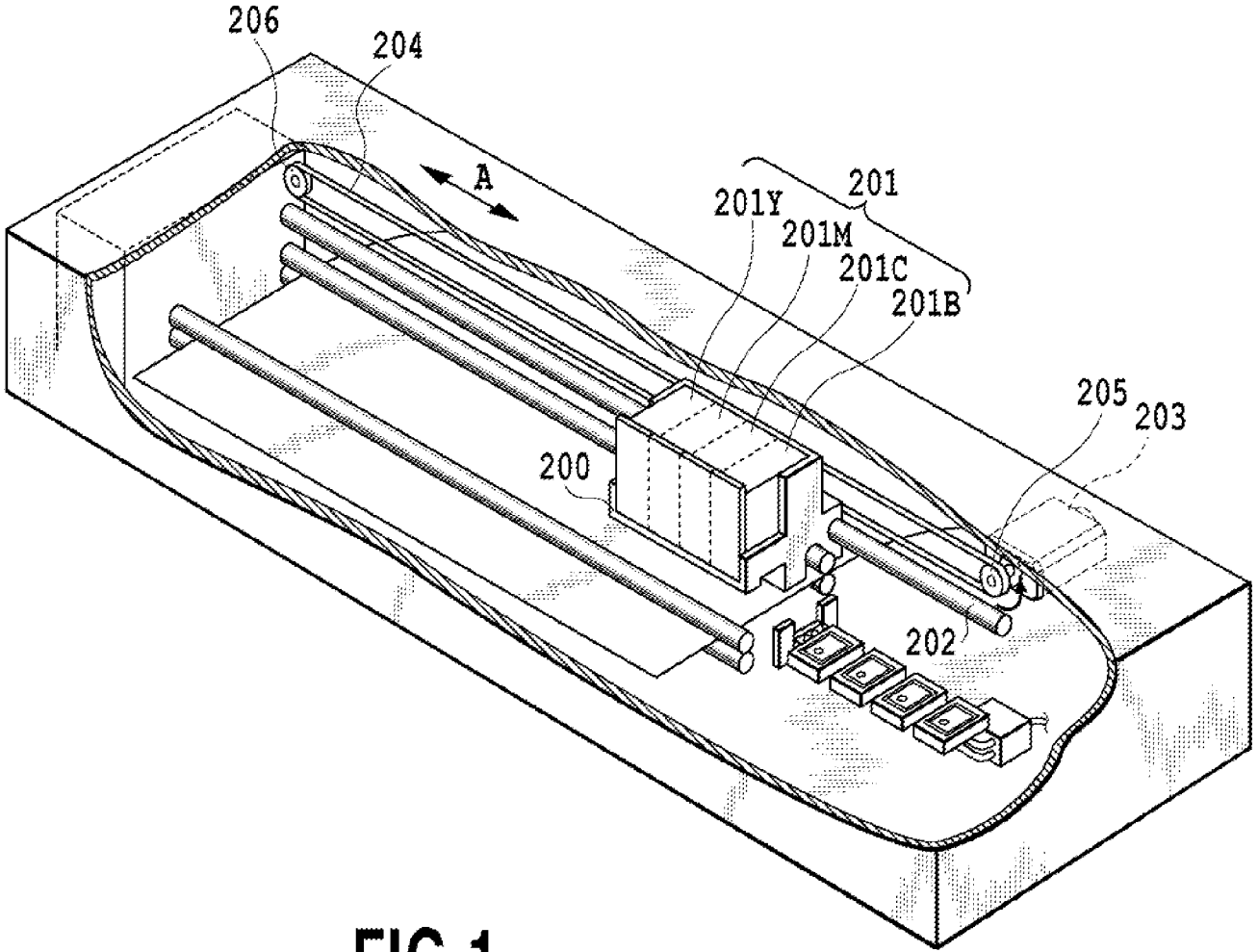
FIG. 1 is a perspective view showing a printing apparatus.

FIG. 1 is a perspective view showing a printing apparatus to which the present embodiment can be applied. The printing apparatus of the present embodiment is a serial scan type printing apparatus, and a guide shaft 202 guides a carriage 200 so that the carriage 200 can move in a main scan direction shown by an arrow A. A belt 204 is connected to the carriage 200, and is stretched between pulleys 205 and 206.

The carriage 200 reciprocates in the main scan direction via the belt 204 according to a rotation direction of the pulley 205 driven by a carriage motor 203. A liquid ejection head 201 is mounted in the carriage 200. The liquid ejection head 201 is a liquid ejection head capable of ejecting liquid, and the liquid ejection head 201 corresponding to inks of four colors is mounted in the carriage 200.

A color image can be printed by mounting, in the carriage 200, a liquid ejection head 201K for a black ink, a liquid ejection head 201C for a cyan ink, a liquid ejection head 201M for a magenta ink, and a liquid ejection head 201Y for a yellow ink.

Figure 2:
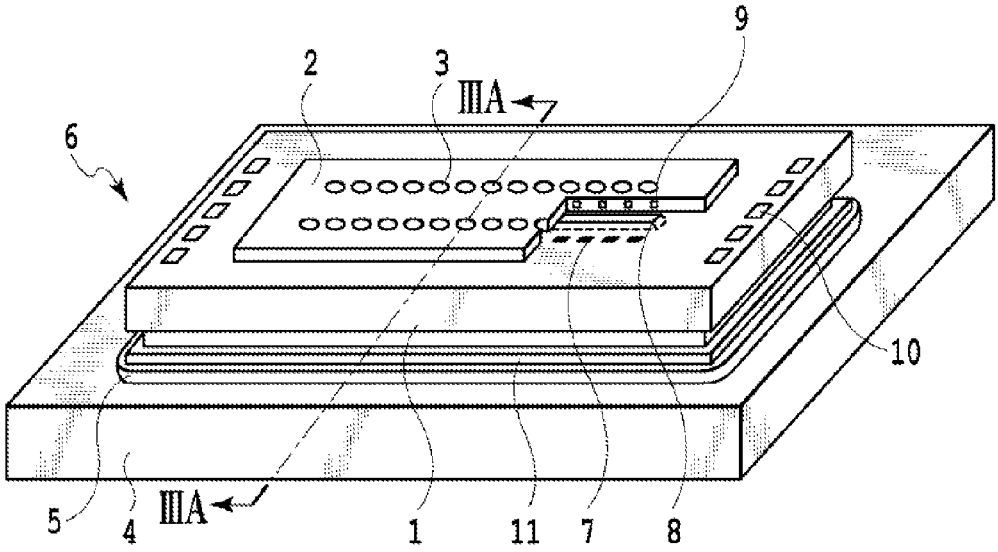
FIG. 2 is a perspective view showing a liquid ejection head.

FIG. 2 is a perspective view showing a liquid ejection head of the present embodiment. The liquid ejection head can be mounted in devices such as a printer, a copier, a facsimile machine having a communication system, and a word processor having a printer section, an industrial printing apparatus obtained by combining various processing devices in a complex manner, and the like. Use of this liquid ejection head 6 makes it possible to print various printing media such as paper, yarn, fiber, leather, metal, plastic, glass, wood, and ceramic.

Incidentally, the word "printing" used in the present specification means not only imparting a character, a figure, or the like to a printing medium, but also imparting an insignificant image such as a pattern.

Further, the word "ink" should be interpreted in a broad sense, and means liquid which serves for formation of an image, a design, a pattern, or the like, processing of a printing medium, or treatment of an ink or the printing medium in a case where the liquid is imparted to the printing medium. The treatment of the ink or the printing medium includes, for example, coagulating or insolubilizing a color material in the ink to be imparted to the printing medium to improve fixing properties, printing quality, color developing properties, image durability, and the like.

The liquid ejection head 6 of the present invention is obtained by bonding, with an adhesive 5, a substrate 1 for the liquid ejection head having energy generating elements 7 (hereinafter simply referred to as "the substrate 1" as well), a flow path forming member 2 formed on the substrate 1 for the liquid ejection head, and a support member 4 forming a flow path and supporting the substrate 1. The flow path forming member 2 has a plurality of through holes penetrating a facing section facing a surface of the substrate 1 for the liquid ejection head on which the energy generating elements 7 are provided.

This flow path forming member 2 is made of a resin material, and the plurality of through holes are collectively provided by using a photolithography technique or an etching technique. The through holes are provided in the flow path forming member 2 so that first openings which are open toward the surface of the substrate 1 for the liquid ejection head on which the energy generating elements 7 are provided communicate with second openings provided on a liquid ejection side. The plurality of through holes are used as ejection openings 3 for ejecting liquid by using energy generated by the energy generating elements 7. These through holes are arranged in lines at a predetermined pitch and form arrays of ejection openings.

It is possible to use electrothermal conversion elements (heaters), piezoelectric elements, or the like as the energy generating elements 7 provided on the substrate 1 for the liquid ejection head. The substrate 1 for the liquid ejection head is made of silicon, and the plurality of energy generating elements 7 are provided in lines at positions of the substrate 1 facing the arrays of the ejection openings and form a plurality of element arrays. An ink supply opening 8 penetrating the substrate 1 for the liquid ejection head is provided between the element arrays to supply liquid to the energy generating elements 7.

Further, the flow path forming member 2 and the substrate 1 for the liquid ejection head are in contact with each other to form ink flow paths 9 in space between the flow path forming member 2 and the substrate 1 for the liquid ejection head. The substrate 1 for the liquid ejection head is provided with connection terminals 10 for supplying power to the energy generating elements 7. The support member 4 is bonded, with the adhesive 5, to a surface of the substrate 1 for the liquid ejection head which is opposite to the surface of the substrate 1 facing the flow path forming member 2. The connection terminals 10 of the substrate 1 are electrically connected, and the energy generating elements 7 are supplied with power to eject liquid.

A slit (a groove or a dent) is provided on the side surface of the substrate 1 to extend along the surface of the substrate 1 bonded to the support member 4, and provided in a side of a surface of the substrate 1 which is opposite to the surface of the substrate 1 facing the flow path forming member 2 as a stress dispersing section 11 which can deform in a case where shrinkage occurs as a result of adhesion of the substrate 1 to the support member 4.

Figure 3B:
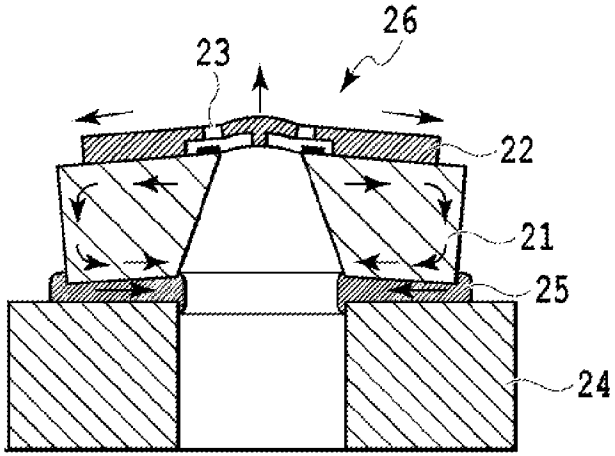
FIG. 3B is a diagram showing the advantageous results of the present invention.
Figure 3A:
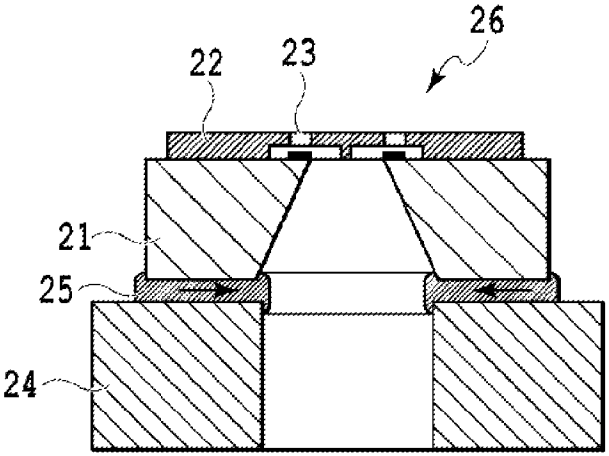
FIG. 3A is a diagram showing the advantageous results of the present invention.
Figure 3D:
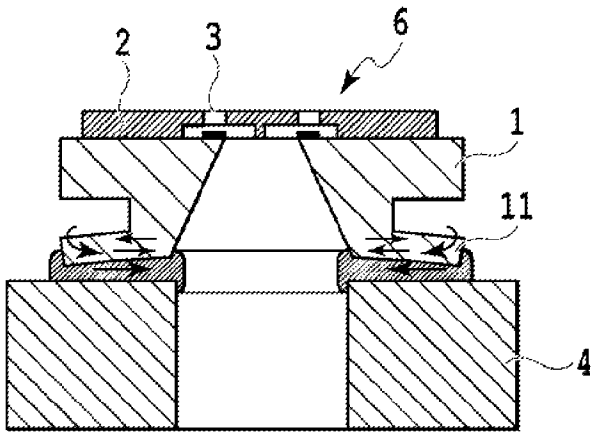
FIG. 3D is a diagram showing the advantageous results of the present invention.
Figure 3C:
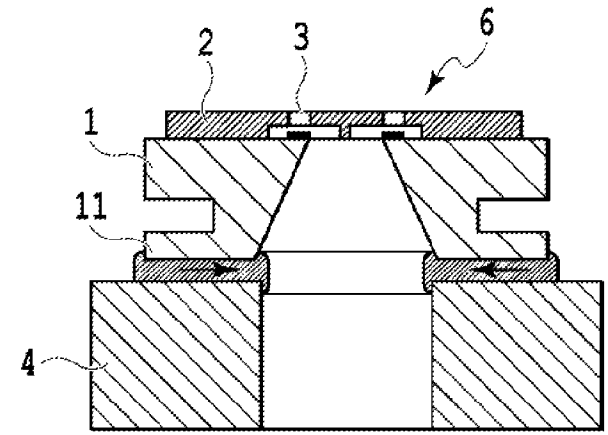
FIG. 3C is a diagram showing the advantageous results of the present invention.

FIGS. 3A to 3D are diagrams for explaining the advantageous results of the present invention. FIGS. 3A and 3B are cross-sectional views of a liquid ejection head 26 using a conventional substrate 21, and FIGS. 3C and 3D are cross-sectional views of the liquid ejection head of the present embodiment. In a conventional structure shown in FIGS. 3A and 3B, the shrinkage stress of an adhesive 25 and a support member 24 serves as tensile stress on the substrate 21. As shown in FIG. 3B, a flow path forming member 22 deforms upward to cause deformation of ejection openings 23 or peeling at an interface with the substrate 21.

In the conventional structure, the flow path forming member 22 as well as the substrate 21 deforms. In contrast, in the present embodiment, the amount of displacement of an upper portion of the substrate 1 and the flow path forming member 2 can be reduced by forming the stress dispersing section 11 which can deform independently of the side surface of the substrate 1 as shown in FIGS. 3C and 3D. This can prevent peeling of the substrate 1 and suppress deformation of the ejection openings 3. Accordingly, it is possible to realize the liquid ejection head which can land an ink droplet at a desired position.

Figure 4:
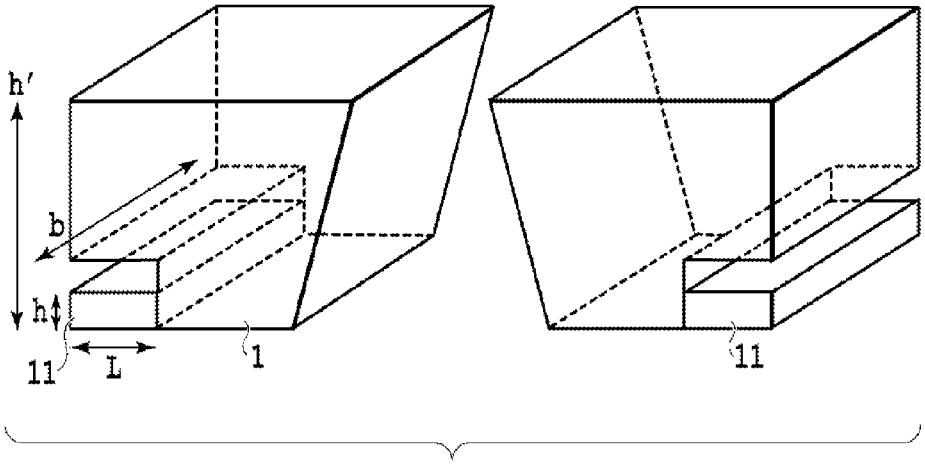
FIG. 4 is a perspective view showing a stress dispersing section 11 of a substrate 1.

FIG. 4 is a perspective view showing the stress dispersing section 11 of the substrate 1 of the present embodiment. The stress dispersing section 11 is a section which is formed by providing the slit (the groove or the dent) on the side surface of the substrate 1 and in which a side of the substrate 1 facing the support member 4 can deform in a case where shrinkage occurs as a result of adhesion of the substrate 1 to the flow path forming member 2 and the support member 4. The stress dispersing section 11 functions as a cantilever. Accordingly, the amount of displacement of the stress dispersing section 11 can be calculated according to a calculation formula for the uniformly distributed load of the cantilever ($\delta=PL4/(8EI)$). This calculation formula is calculated by using P: a distributed load [N], I: cross-sectional secondary moment [$mm^4$], E: a Young's modulus [$N/mm^2$], and L: the length of the cantilever [mm].

Further, the cross-sectional secondary moment I is represented by $I=bh^3/12$ where b is the width of the cantilever and h is the height of the cantilever. The groove for forming the stress dispersing section 11 is provided at a position to be not in contact with the support member 4. The stress dispersing section 11 deforms to absorb stress on the upper portion of the substrate 1 and the flow path forming member 2. Accordingly, it is preferable that the height h of the stress dispersing section 11 be low, and that the length L of the stress dispersing section 11 be long ($0<h\leq L$). It is preferable that the height h of the cantilever be equal to or lower than half of the thickness h' of the substrate 1. Since stress caused by curing and contraction of the support member 4 is applied to the whole surface of the substrate 1, it is preferable that the stress dispersing member 11 be provided in the whole periphery including all of the sides of the substrate 1. Providing the stress dispersing section, that is, the groove, in the whole periphery means that the stress dispersing section is formed throughout the periphery of the substrate.

FIGS. 5A to 5F are diagrams illustrating a process for producing the liquid ejection head of the present embodiment. The method for producing the liquid ejection head of the present embodiment will be described below with reference to FIGS. 5A to 5F.

Figures 5A, 5B, 5C, 5D, 5F:
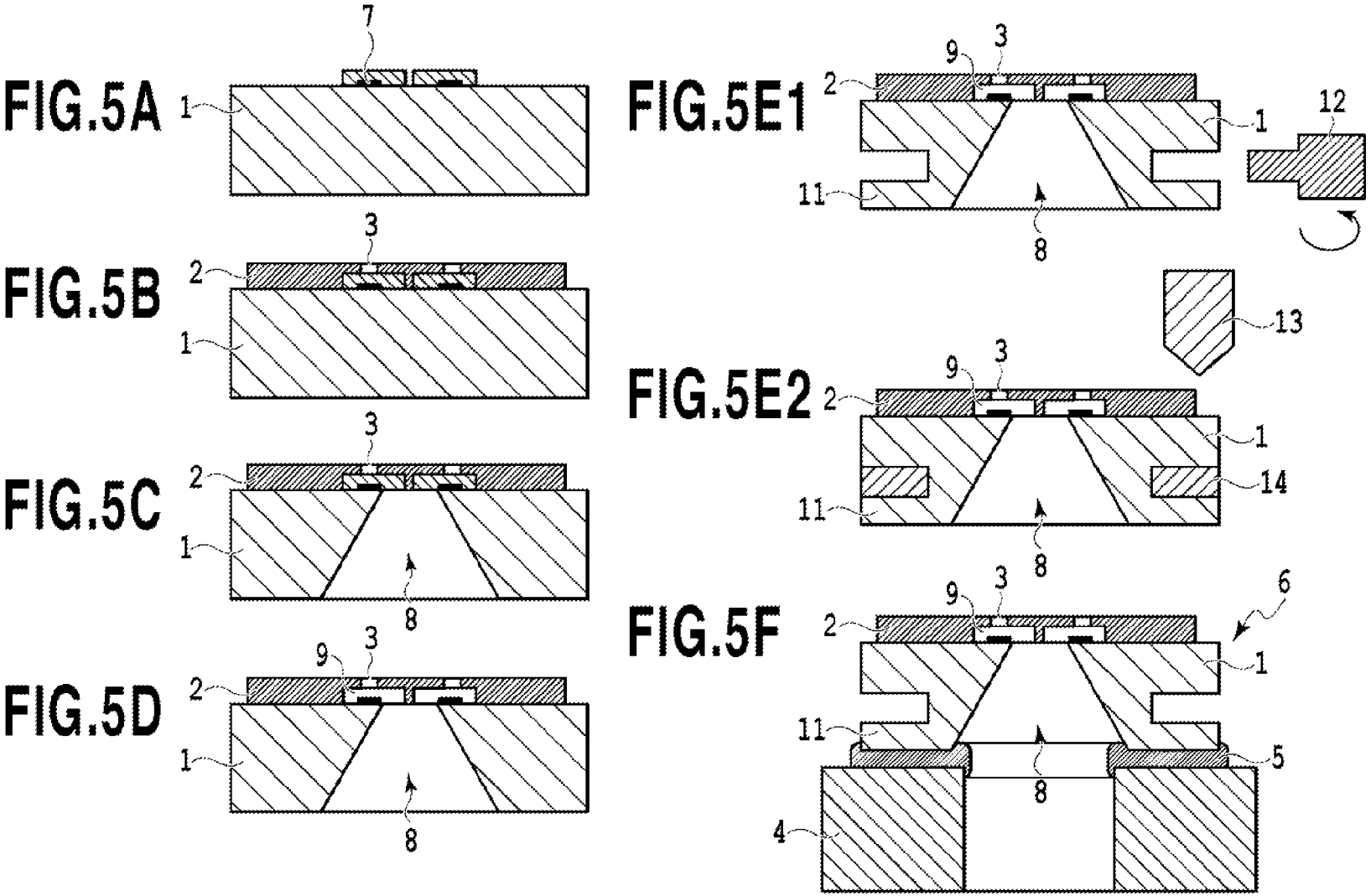
FIG. 5A is a diagram illustrating a process for producing the liquid ejection head.
FIG. 5B is a diagram illustrating the process for producing the liquid ejection head.
FIG. 5C is a diagram illustrating the process for producing the liquid ejection head.
FIG. 5D is a diagram illustrating the process for producing the liquid ejection head.
FIG. 5F is a diagram illustrating the process for producing the liquid ejection head.

As shown in FIG. 5A, a positive photosensitive resin layer is formed on the substrate 1 on which the energy generating elements 7 are provided, and the positive photosensitive resin layer is patterned by using photolithography to form patterns of the ink flow paths 9. Next, as shown in FIG. 5B, a negative photosensitive resin layer which forms the flow path forming member 2 is formed on the substrate 1 on which the patterns of the ink flow paths 9 are formed, and patterned to form patterns of the ejection openings 3. Then, as shown in FIG. 5C, the substrate is subjected to anisotropic etching to form the ink supply openings 8. Thereafter, as shown in FIG. 5D, the positive photosensitive rein layer forming the patterns of the ink flow paths 9 is removed to form the ink flow paths in the flow path forming member 2.

Next, after a wafer is cut into chips by using a dicer or the like, an opening groove is formed on the side surface of the substrate of the present invention to form the stress dispersing section 11 as shown in FIG. 5E1. More specifically, the stress dispersing section 11 is formed by changing the shape of a beveling wheel 12 generally used for machining an outer peripheral portion of a wafer to a convex shape to machine the side surface of the cut substrate 1.

Further, in the method for producing the stress dispersing section 11, a modified layer 14 in which cracks will grow in a case where stress is applied to an end of the substrate may be formed by using a stealth dicing technique and a laser 13 as shown in FIG. 5E2, and the modified layer 14 may be formed so that in a case where stress is applied to the substrate 1, the modified layer 1 crumbles. In the present embodiment, the stress dispersing section 11 is formed to have a height h of 50 μm and a length L of 150 μm.

Further, the size of the cut substrate is 2 mm×20 mm. Next, as shown in FIG. 5F, the substrate 1 is bonded to the support member 4 with the adhesive 5. The adhesive 5 is applied to the extent that the back surface of the substrate 1 can be fixed. A resin material having thermosetting properties such as an epoxy resin is used as the adhesive. In a case where heating for curing causes stress of 100 N to be applied to the substrate 1, the amount of displacement of the stress dispersing section 11 is 1.8 μm in a short side and 0.2 μm in a long side. After the stress dispersing section 11 is formed in this manner, the contact pads (connection terminals) 10 of the substrate are electrically connected (not shown) and main components of the liquid ejection head 6 are completed.

Forming the stress dispersing section 11 on the side surface of the substrate 1 in this manner makes it possible to realize the liquid ejection head capable of performing high-quality printing by suppressing the shrinkage stress of the adhesive bonding the substrate to the flow path forming member and the deformation and peeling of the flow path forming member.

OTHER EMBODIMENTS

Other embodiments of the present invention will be described below with reference to the drawings. Incidentally, the basic features of the present embodiments are identical to those of the above-described embodiment, and only characterizing features will be described below.

Figure 6A:
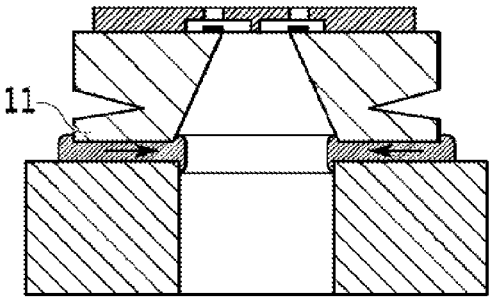
FIG. 6A is a diagram showing another embodiment of the present invention.
Figure 6B:
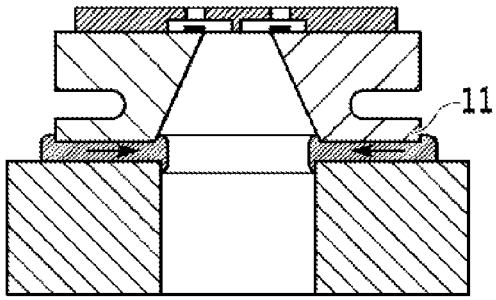
FIG. 6B is a diagram showing another embodiment of the present invention.

FIGS. 6A and 6B are diagrams showing the other embodiments of the present invention. As shown in FIGS. 6A and 6B, a slit, a groove, or a dent for forming the stress dispersing section 11 may be in any form as long as the stress dispersing section 11 can be displaced as the cantilever.

Further, the slit, the groove, or the dent is not necessarily one in number, and may be more than one in number.

Such structures can also produce advantageous results similar to the above-described advantageous results, and can realize the liquid ejection head capable of performing high-quality printing by suppressing the shrinkage stress of the adhesive bonding the substrate to the flow path forming member and the deformation and peeling of the flow path forming member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-176856, filed Aug. 28, 2013, which is hereby incorporated by reference herein in its entirety.

What is claimed is:

1. A liquid ejection head comprising:

a flow path forming member comprising an ejection opening for ejecting liquid;

a substrate attached to the flow path forming member; and a support member for supporting the substrate, the flow path forming member being provided on a first surface of the substrate, and the support member being provided on a second surface of the substrate opposite to the first surface;

wherein a groove extends adjacent the second surface and is formed on a side surface of the substrate which connects the first surface and the second surface.

2. A liquid ejection head according to claim 1, wherein the groove is provided throughout the whole side surface of the substrate.

3. A liquid ejection head according to claim 1, wherein the substrate is formed of silicon.

4. A liquid ejection head according to claim 1, wherein $h \leq L$ where h is a height from the second surface to the groove, and L is a depth of the groove.

5. A liquid ejection head according to claim 1, wherein the groove is provided plural in number.

6. A printing apparatus comprising the liquid ejection head according to claim 1.

* * * * *